US008091725B2

(12) United States Patent
Koerber et al.

(10) Patent No.: US 8,091,725 B2
(45) Date of Patent: Jan. 10, 2012

(54) ANTI-TWIST DEVICE FOR A CONTAINER

(75) Inventors: René Koerber, Leutenbach (DE); Helmut Fuchs, Urbach (DE)

(73) Assignee: Reutter Metallwarenfabrik GmbH, Waiblingen (DE)

( * ) Notice: Subject to any disclaimer, the term of this patent is extended or adjusted under 35 U.S.C. 154(b) by 1187 days.

(21) Appl. No.: 10/587,145

(22) PCT Filed: Nov. 5, 2004

(86) PCT No.: PCT/EP2004/012573

§ 371 (c)(1),
(2), (4) Date: Jul. 10, 2007

(87) PCT Pub. No.: WO2005/073532

PCT Pub. Date: Aug. 11, 2005

(65) Prior Publication Data

US 2007/0289969 A1 Dec. 20, 2007

(30) Foreign Application Priority Data

Jan. 22, 2004 (DE) ..... 20 2004 001 333 U

(51) Int. Cl.
*B65D 41/04* (2006.01)

(52) U.S. Cl. ..... 220/315; 220/203.23; 220/203.26; 220/203.27; 220/288; 220/303; 220/367.1; 220/DIG. 32; 220/DIG. 33

(58) Field of Classification Search ..... 220/203.23, 220/203.26, 303, 315, 203.27, 288, 367.1, 220/DIG. 32, DIG. 33
See application file for complete search history.

(56) References Cited

U.S. PATENT DOCUMENTS

2003/0183632 A1* 10/2003 Reutter ..... 220/203.23

FOREIGN PATENT DOCUMENTS

| | | |
|---|---|---|
| DE | 199 46 845 C2 | 4/2001 |
| DE | 100 35 729 A1 | 1/2002 |
| DE | 101 64 669 A1 | 7/2003 |

* cited by examiner

*Primary Examiner* — Anthony Stashick
*Assistant Examiner* — Elizabeth Volz
(74) *Attorney, Agent, or Firm* — Bacon & Thomas, PLLC

(57) ABSTRACT

An anti-twist device for a sealing cap that is located on a fixed connecting piece of a motor vehicle radiator. The sealing cap comprises an external cap part with a grip element and a sealing element, which can be connected to a counter sealing element of the connecting piece and in relation to which the grip element can be rotated. The sealing cap also comprises an internal cap part comprising a valve assembly that is configured in an excess/negative pressure combination. An anti-twist stop acts in the external cap part between the grip element and the sealing element. An anti-twist device of this type has a no-load function instead of a locking function and yet has a simple construction and is easy to produce. To achieve this, the anti-twist stop can be actuated by means of a drive, which is controlled by the operating data in the container and is located inside said container in close proximity to the external cap part.

6 Claims, 4 Drawing Sheets

ANTI-TWIST DEVICE FOR A CONTAINER

FIELD OF THE INVENTION

The present invention relates to an anti-twist device for a sealing cap, mountable or mounted on a fixed connecting piece of a container, in particular a motor vehicle radiator.

BACKGROUND OF THE INVENTION

In one such anti-twist device, known from German Patent Disclosure DE 100 35 729 A1, the anti-twist stop is embodied as a coupling insert, whose axial disengagement and engagement motion is derived from a pressure-dependent axial motion of a valve body of the valve assembly. This type of drive of the anti-twist stop is relatively complicated, and it cannot be used particularly whenever there is no valve assembly embodied as an excess/negative pressure combination.

A simplified anti-twist stop between the sealing element of the sealing cap on the one hand and the container on the other is described in German Patent Disclosure DE 101 64 669 A1, in which a drive, accommodated inside the container, is provided with a blocking bolt which plunge directly into the sealing element of the sealing cap. This means that the anti-twist device is designed such that rotational locking is done between the sealing cap and the container. A disadvantage of this is that it cannot be told in advance whether the sealing cap is only firmly seated or is actually locked, which means that if too much force is expended, the blocking bolt can be broken off.

SUMMARY OF THE INVENTION

The object of the present invention is therefore to provide an anti-twist device for a sealing cap, mountable or mounted on a fixed connecting piece of a container, in particular a motor vehicle radiator, of the type defined at the outset which on the one hand, instead of a locking function has an idle-travel function and on the other is nevertheless constructed more simply from the standpoint of both engineering and production.

For attaining this object, in an anti-twist device for a sealing cap, mountable or mounted on a fixed connecting piece of a container, in particular a motor vehicle radiator, the anti-twist stop is actuatable by means of a drive triggered by the operating data in the container, the drive being accommodated inside the container near the external cap part.

By the provisions according to the invention, on the one hand a rotation preventer in the form of an idle-travel connection is obtained between the grip element and the sealing element of the external cap part, and furthermore, a drive connection acting on this anti-twist stop is obtained, which originates from inside the container and is thus directly exposed to the pressure and temperature present in the container. There is no mechanical connection, which might possibly be damaged, between the container and the sealing cap.

In a preferred embodiment of the drive, a drive part is disposed on a circumferential region of a container wall adjacent to the connecting piece. The drive may be formed by two or more drive parts, distributed preferably uniformly over the circumference of a container wall adjacent to the connecting piece. The individual drive parts can be held in position for instance by a ring, or in the manner whereby each of two drive parts is disposed, held separately, inside the container and tangentially below the counterpart sealing element of the connecting piece, so that a spatially direct association is achieved between the drive in the container and the anti-twist stop in the sealing cap. For simplification in terms of engineering and assembly, each drive part is received in a housing that is held suspended from the container wall. The housing is held in pressure tight fashion in a recess in the container wall. The housing is comprised of a hood part, protruding from the container wall, and a basket part whose bottom is provided with an opening. The hood part is provided with an axial leadthrough, which penetrates the container wall and is held in it in pressure tight fashion. The hood part and the basket part are joined, locking over and in one another. Each drive part has a vertically oriented actuation bolt, which, facing toward the anti-twist stop, is covered by a diaphragm, which is fastened tightly between the hood part and the basket part.

According to one feature the drive part is pressure-controlled, and its activation bolt is spring-loaded in the opposite direction, the drive in the container is pressure-controlled; it is also possible for it to be thermally controlled.

The present invention also relates to a unit comprising a container with a connecting piece and a sealing cap, or comprising a container connecting piece and a sealing cap, which is provided with an anti-twist device of the invention.

BRIEF DESCRIPTION OF THE DRAWINGS

Further details of the invention can be learned from the ensuing description, in which the invention is described and explained in further detail in terms of an exemplary embodiment shown in the drawings. Shown are.

DESCRIPTION OF THE PREFERRED EMBODIMENTS

Figure 1:
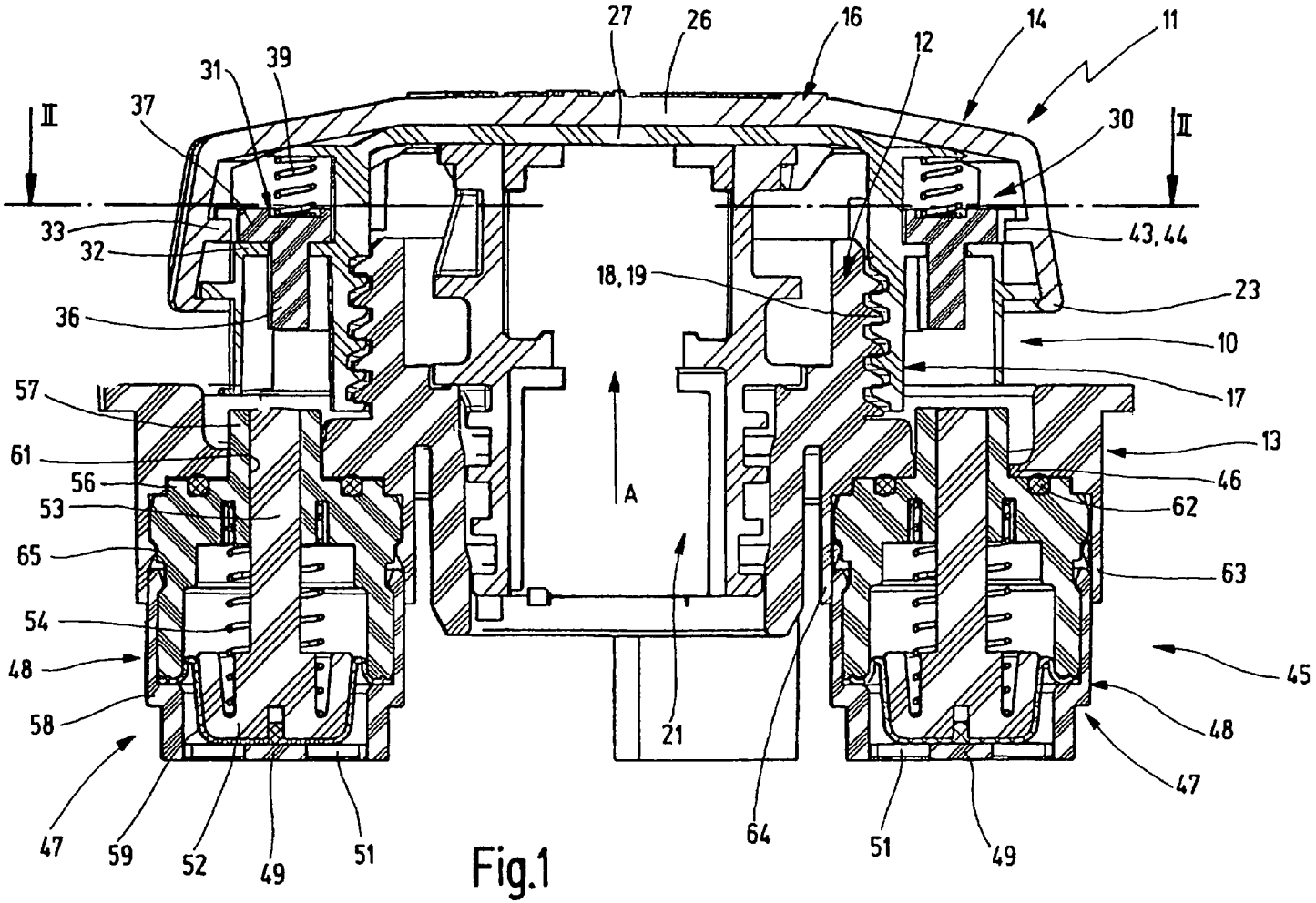
FIG. 1, in a schematic longitudinal section, a sealing cap, mounted on a motor vehicle radiator, with a pressure-controlled anti-twist stop in the coupled state, in a preferred exemplary embodiment of the present invention.

The anti-twist device 10, shown in the drawings in a preferred exemplary embodiment, serves the purpose of operationally controlled prevention of unscrewing a sealing cap 11 from the sealing connecting piece 12 of a container 13, such as a motor vehicle radiator, whenever because of the operating state of the container (elevated pressure or temperature) unscrewing the sealing cap 11 from the container connecting piece 12 can involve risks to the user.

The sealing cap 11 has an external cap part 14, which is provided with a grip element 16 and a sealing element 17, and the sealing element in this case has a female thread 18 for screwing the sealing cap 11 onto and unscrewing it from the opening of the sealing connecting piece 12, provided with a male thread 19, of the motor vehicle radiator 13 or other container. It is understood that instead of being provided with a thread, the sealing element 17 may be provided with a bayonet-type cap, which can be connected to a corresponding sealing part on the connecting piece. On the inside of the sealing cap 11, concentric with the sealing element 17 and suspended from it, an internal cap part 21 is disposed, which is held rotatably relative to the sealing element 17 of the external cap part 14 but firmly held axially. The internal cap part 21 may, in a manner not shown, be embodied as a valve pot, which can for instance have an excess/negative pressure valve assembly, whose excess pressure valve is triggerable in a single stage or in two stages.

As can be seen from the drawings, the grip element 16 is fitted over the sealing element 17 and engages it from below annularly; an internal annular extension 23 of the grip element 16 engages an outer annular extension 34 of the sealing element 17 from below. Thus the grip element 16 is held freely rotatably relative to the sealing element 17, but is axially fixed. The counterpart support or contact is formed by the two contacting top walls 26 and 27 of the grip element 16 and sealing element 17, respectively.

Figure 2:
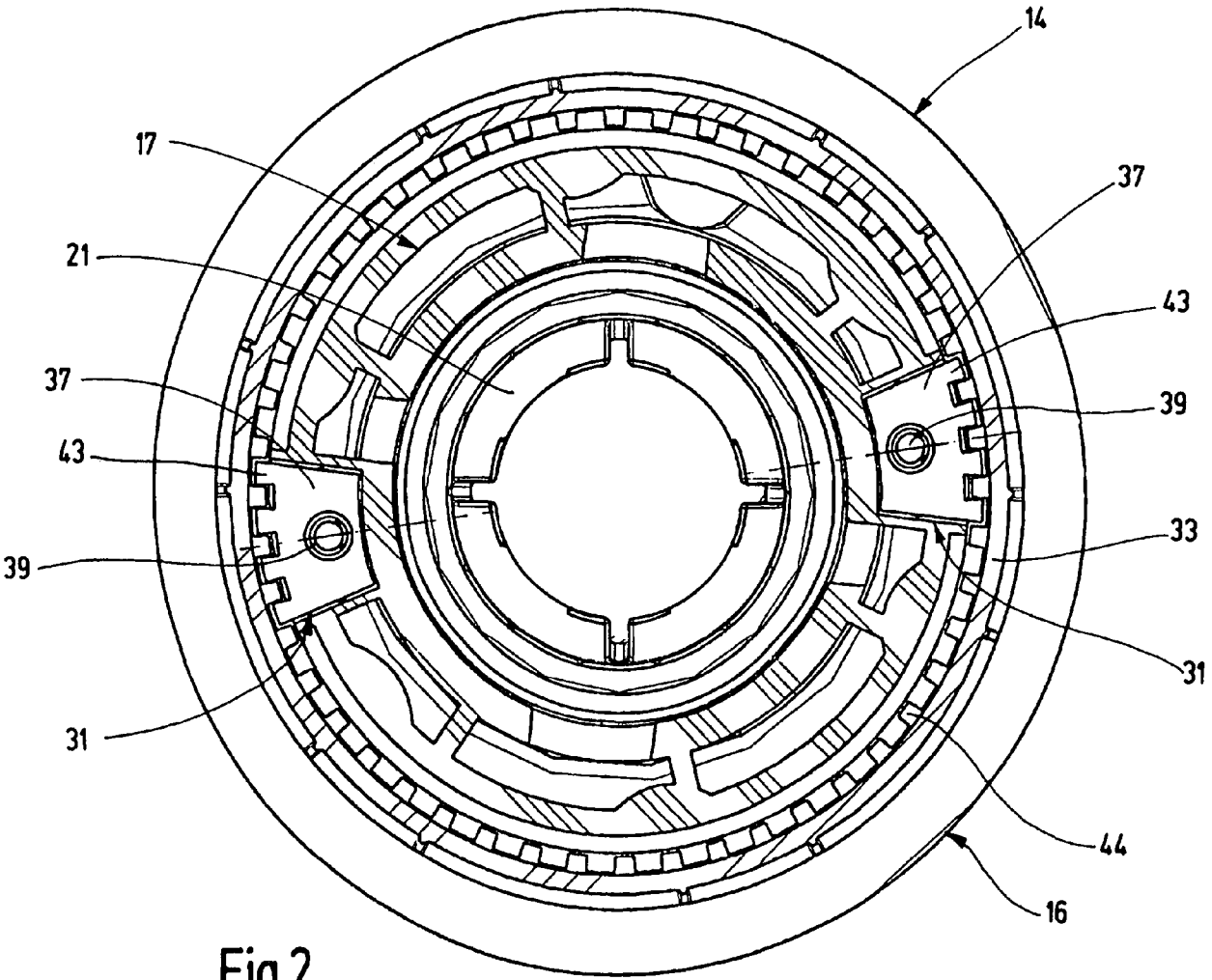
FIG. 2, a section taken along the line 11-11 of FIG. 1.

In order to design the grip element 16 and the sealing element 17 freely rotatably relative to one another for certain operating states, on the one hand, and on the other to attain a connection that is fixed against relative rotation for the normal situation, an indexable or coupleable anti-twist stop 30 is provided between the grip element 16 and the sealing element 17. The anti-twist stop 30 here has two diametrically opposed engageable and disengageable coupling elements 31, each of which in the engagement position in FIG. 1 is loaded by a compression spring 29. Each coupling element 31 has one coupling bolt 36, oriented axially to the underside of the sealing element 17, and one approximately trapezoidal coupling locking bar 37 firmly joined to it. The coupling bolt 36 of the coupling element 31, which in longitudinal section is approximately T-shaped, is held axially movably but in a manner fixed against relative rotation inside the sealing element 17, for instance in a bore. The coupling locking bar 37, radially on its outside, has a set of teeth 43, which is brought into connection, in a manner fixed against relative rotation, with a radially inner set of teeth 44 on an annular collar 33, extending all the way around on the inside, of the grip element 16 as shown in FIGS. 1 and 2. In other words, in the pressureless outset state of the container 13, as shown in FIGS. 1 and 2, the coupling locking bar 37, under the action of the compression spring 39, rests by positive engagement in the annular collar 33 of the grip element 16, and in this engaged coupling position, it is located on an annular wall 32 of the sealing element 17. The free end of the coupling bolt 36, remote from the compression spring 39 and the coupling locking bar 37, is located inside an annular chamber of the sealing element 17, which chamber is open toward the container 13.

For the axial disengagement motion in the direction of the arrow A of the coupling element 31, a drive 45 is provided in the container 13, on a wall 46 of the container 13 that surrounds the sealing connecting piece 12 below the male thread 19, and inside the container 13. The drive 45 here comprises two drive parts 47, which on two diametrically opposed sides of the annular wall 46 surrounding the sealing connecting piece 12, suspended from the underside of this wall in the container 13. Each drive part has a cylindrical housing 48, which hangs downward from the annular wall 46 and which on its bottom 49 has an opening 51 into the container interior. The two drive parts 47, in parallel axial alignment, are located below the coupling bolt 36 of the applicable coupling element 31. A piston 52 with an axial tappet 53 and a compression spring 54 are provided, in the form of an upside-down T, inside the housing 48. The compression spring 45, which is braced on an inner side of the housing 48, presses the piston 52 against the bottom 49 of the housing 48. The housing 48 substantially comprises a hood part 56, which is provided with a leadthrough 57, and a basket part 58, whose bottom 49 has the annularly disposed openings 51. By its end remote from the bottom 49, the basket part 58 is thrust over the end of the hood part 56 remote from the leadthrough 57 and is held in locking fashion. A diaphragm 59 is fastened between an annular end face of the hood part 56 and an annular shoulder of the basket part 58 and wraps around the piston 52 and thus seals off the housing interior from the container interior. The leadthrough 57 of the hood part 56 is press-fitted into a bore 61 of the annular wall 46 of the container 13 or firmly held in some other way such that a tight connection results. The annular face of the hood part 56 around the leadthrough 57 is provided with an O-ring 62, with which a sealing action can be attained in such a way that the hood part 56 is locked by positive engagement at the annular point 65 between container walls 63, 64 that protrude perpendicular to the annular wall 46. The leadthrough 57 of the hood part 56 is such that the tappet 53 of the piston 52 of the drive part 47, in the pressureless state shown in FIG. 1, penetrates the leadthrough 57 but does not protrude past it.

Figure 3:
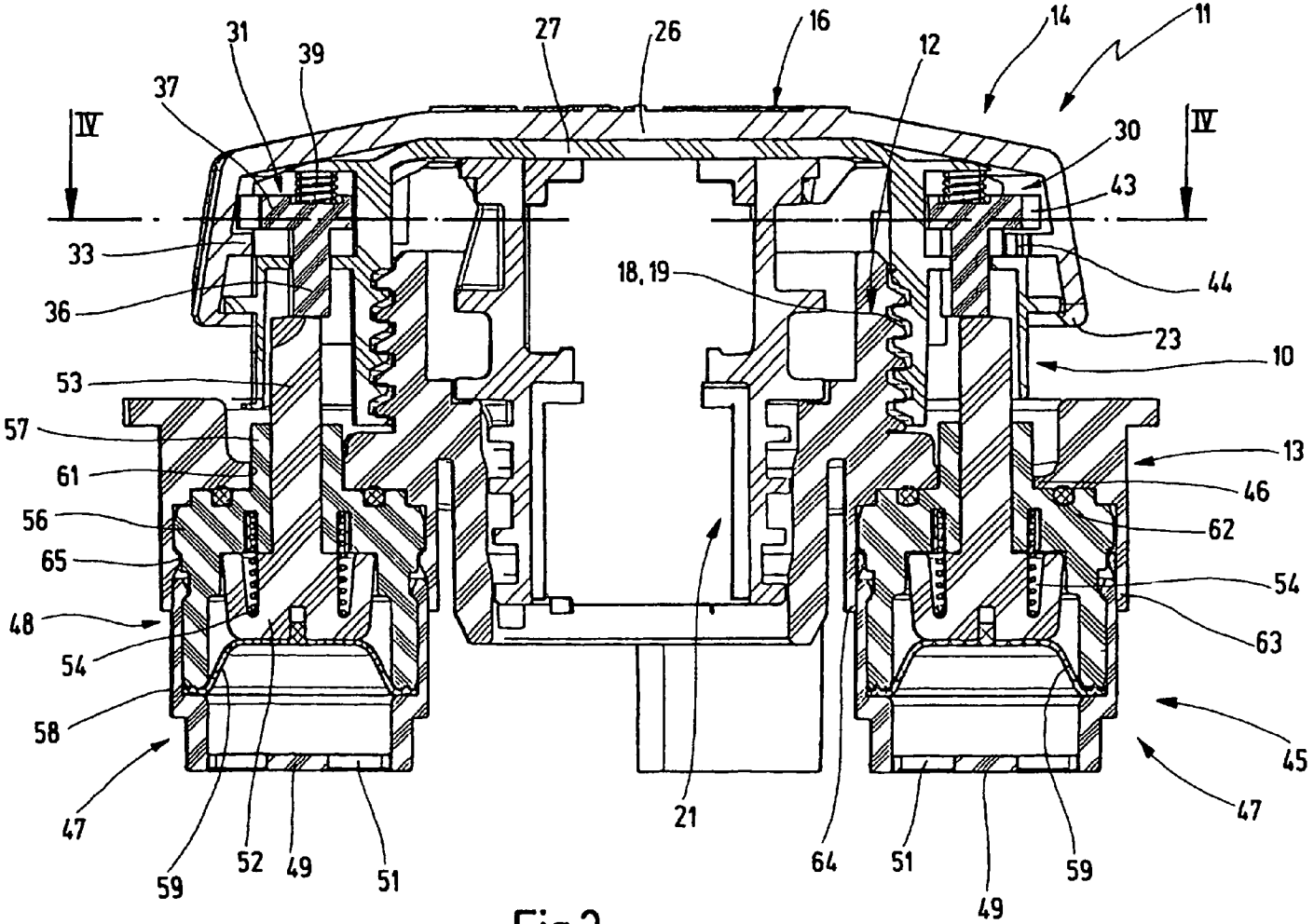
FIG. 3, a view corresponding to FIG. 1, but with the anti-twist stop in the uncoupled state.
Figure 4:
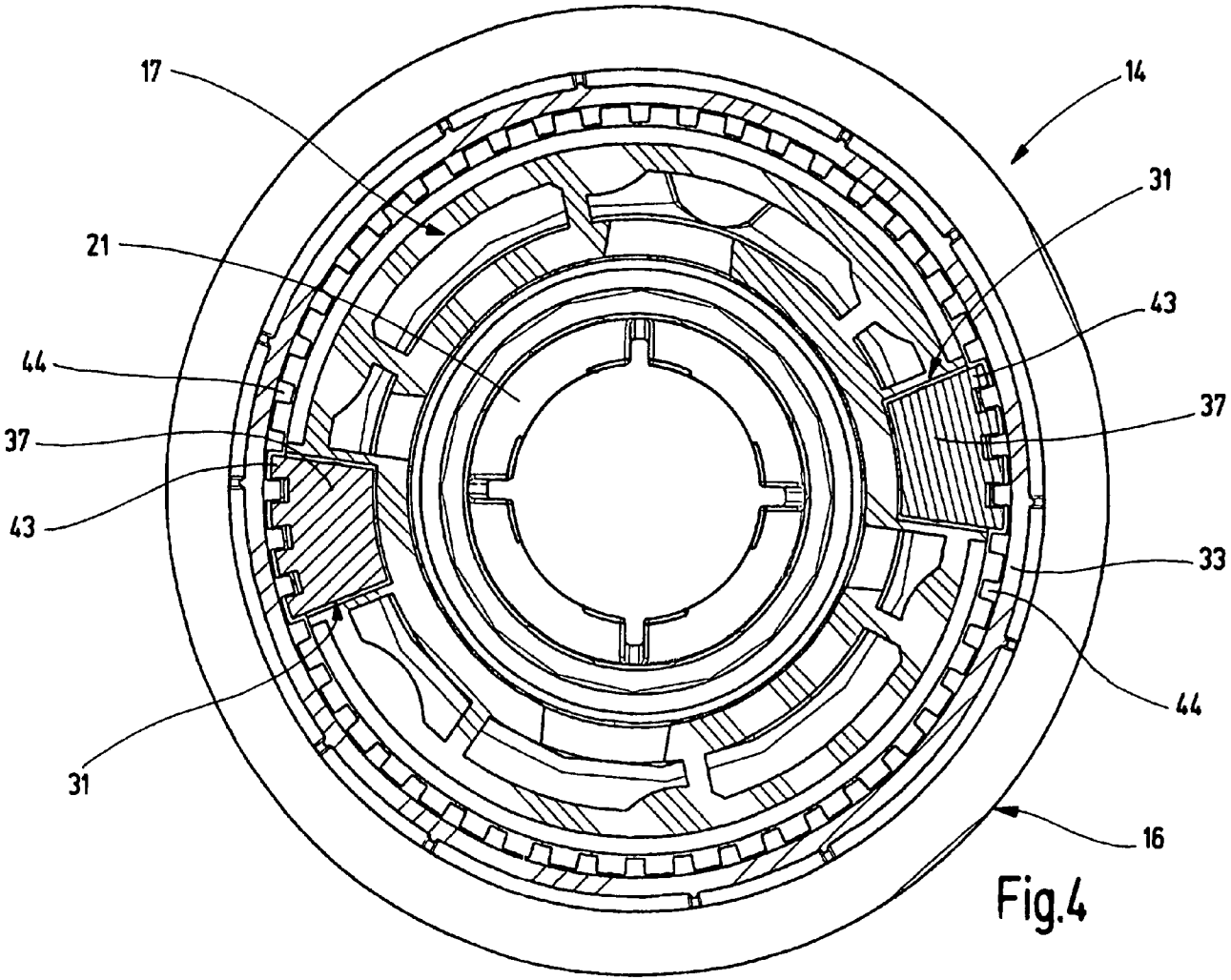
FIG. 4, a section taken along the line IV-IV of FIG. 3.

Thus the two drive parts 47 are exposed to the internal pressure in the container 13. If the internal pressure in the container 13 exceeds the specified allowable pressure, the piston 52 is moved with the tappet 53 in the axial direction A; the tappet 53 meets the coupling bolt 36 and disengages the coupling locking bar 37 of the coupling element 31 from its connection, fixed against relative rotation, with the grip element 16 (FIGS. 3 and 4). In this position of the coupling locking bar 37, disengaged from the connection that is fixed against relative rotation, the grip element 16 rotates idly relative to the sealing element 17, so that unscrewing the sealing cap 11 from the sealing connecting piece 12 of the container 13 is not possible. Not until the internal pressure in the container 13 drops again does the piston tappet 53 move, and as a consequence of it the coupling bolt 36 and coupling locking bar 37, under the influence of the respective compression spring 54 and 39, into the outset position and hence the coupling engagement position shown in FIGS. 1 and 2. This can be done in every relative rotated position of the grip element 16 compared to the coupling elements 31, since the set of teeth 44 in the annular collar 33 of the grip element 16 is provided over the entire 360° circumference.

It also remains to be said that in a manner not shown, a stop is integrated into the sealing cap, and this assures that in the state in which the sealing cap 11 is screwed onto the sealing connecting piece 12, the two coupling elements 31 of the anti-twist stop 30 are located axially diametrically opposite the two drive parts 47 of the drive 45.

Although in the exemplary embodiment shown two diametrically opposed coupling elements 31 and correspondingly two diametrically opposed drive parts 47 are provided, it is understood that more than two such pairs of elements, for instance offset by 90°, can be located diametrically opposite two further such pairs. However, it is also possible to make due with only one pair comprising one coupling element 31 and one drive part 47.

It is furthermore possible to provide the drive part 47, instead of with a piston that reacts to the internal pressure conditions in the container 13, with a thermal expansion element that responds to the internal temperature in the container 13.

The invention claimed is:

1. An anti-twist device for a sealing cap, mountable or mounted on a fixed connecting piece of a container, said sealing cap having:

an external cap part with a grip element and with a sealing element that is connectable to a counterpart sealing element of the connecting piece, relative to which sealing element said grip element is kept relatively rotatable;

an internal cap part with a valve assembly embodied as an excess/negative pressure combination;

an anti-twist stop in the external cap part which acts between said grip element and said sealing element; and a drive triggered by the operating data in the container, the drive being accommodated inside the container near the external cap part and serving to actuate said anti-twist stop, said drive has a drive part, disposed on a circumferential region of a container wall adjacent to the connecting piece.

2. The anti-twist device as defined by claim 1, wherein:

said anti-twist stop has a horizontally disposed and axially movable coupling unit.

3. The anti-twist device as defined by claim 1, wherein:

the drive part has a vertically oriented actuation bolt, which, facing toward said anti-twist stop, penetrates the container wall.

4. The anti-twist device as defined by claim 3, wherein:

said drive part is pressure-controlled, and its actuation bolt is spring-loaded in the opposite direction.

5. A unit comprising a container having one of: a connecting piece, and a container connecting piece and a sealing cap, having an anti-twist device, said sealing cap having:

an external cap part with a grip element and with a sealing element that is connectable to a counterpart sealing element of the connecting piece, relative to which sealing element said grip element is kept relatively rotatable;

an internal cap part with a valve assembly embodied as an excess/negative pressure combination;

an anti-twist stop in the external cap part which acts between said grip element and said sealing element; and a drive triggered by the operating data in the container, the drive being accommodated inside the container near the external cap part and serving to actuate said anti-twist stop, said drive has a drive part, disposed on a circumferential region of a container wall adjacent to the connecting piece.

6. An anti-twist device for a sealing cap, mountable or mounted on a fixed connecting piece of a container, said sealing cap having:

an external cap part with a grip element and with a sealing element that is connectable to a counterpart sealing element of the connecting piece, relative to which sealing element said grip element is kept relatively rotatable;

an internal cap part with a valve assembly embodied as an excess/negative pressure combination;

an anti-twist stop in the external cap part which acts between said grip element and said sealing element;

a drive triggered by the operating data in the container, the drive being accommodated inside the container near the external cap part and serving to actuate said anti-twist stop, said drive has a drive part, disposed on a circumferential region of a container wall adjacent to the connecting piece, wherein:

each drive part has a vertically oriented actuation bolt, which, facing toward said anti-twist stop, penetrates the container wall; and said actuation bolt, on its end remote from said anti-twist stop, is covered by a diaphragm, which is fastened tightly between a hood part and a basket part.

* * * * *